US005935769A

United States Patent [19]

Tsukada

[11] Patent Number: 5,935,769

[45] Date of Patent: Aug. 10, 1999

[54] PROCESSING METHOD FOR SILVER HALIDE BLACK AND WHITE PHOTOGRAPHIC LIGHT SENSITIVE MATERIAL

[75] Inventor: Kazuya Tsukada, Hino, Japan

[73] Assignee: Konica Corporation, Tokyo, Japan

[21] Appl. No.: 08/986,108

[22] Filed: Dec. 5, 1997

[30] Foreign Application Priority Data

Dec. 9, 1996 [JP] Japan ..... 8-328484

[51] Int. Cl.[6] ..... G03C 5/29

[52] U.S. Cl. ..... 430/440; 430/446; 430/465; 430/533

[58] Field of Search ..... 430/440, 446, 430/465, 533

[56] References Cited

U.S. PATENT DOCUMENTS 5,691,108 11/1997 Hirano et al. ..... 430/465

5,747,229 5/1998 Hasegawa ..... 430/465

*Primary Examiner*—Hoa Van Le

*Attorney, Agent, or Firm*—Frishauf, Holtz, Goodman, Langer & Chick, P.C.

[57] ABSTRACT

A method for processing a silver halide black-and-white photographic light sensitive material comprising a transparent polyester support having thereon hydrophilic colloid layers including a silver halide emulsion layer, by the use of an automatic processor, the method comprising the steps of developing with a developing solution; fixing with a fixing solution, washing and drying, wherein the polyester support is a biaxially stretched polyester film obtained from a naphthalenedicarboxylic acid and a diol; the developing solution and the fixing solution being prepared by dissolving, in water, a solid developing composition and a solid fixing composition, respectively.

9 Claims, No Drawings

PROCESSING METHOD FOR SILVER HALIDE BLACK AND WHITE PHOTOGRAPHIC LIGHT SENSITIVE MATERIAL

FIELD OF THE INVENTION

The present invention relates to a method for processing a silver halide black-and-white photographic light sensitive material.

BACKGROUND OF THE INVENTION

Photographic processing chemicals in liquid form which have been conventionally employed have problems such that stain due to splashing is marked in their preparation, they are very heavy, substantial storage space is needed and the empty bottles are voluminous; and countermeasures to these problems are desired.

On the other hand, solid processing compositions in which a conventionally employed concentrated solution is solidified, overcome the problems described above. Thus, the solidification results in light weight and compactness, leading to not only improved working property in preparing processing solutions including handling characteristics and storage space, but also reduced staining due to, for example, spilling at the time of preparing the processing solutions and spattering at the time a bottle is broken during transportation and the solution runs out, so that it becomes a very easily handled processing chemicals for the user.

Since the solid processing composition contains little moisture, reactivity between components decreases, leading to improved storage stability, as compared to conventionally employed concentrated liquids. Further, when processing at a low replenishing rate, it is necessary to increase some components of the concentrated liquid but an increase thereof must be limited due to precipitation of some of the components. To the contrary, the solid processing composition, which is unaffected by precipitation, is useful in processing at a low replenishing rate.

The solid processing composition contains characteristic materials such as a binder necessary for solidification. The inventor studied photographic processing performance in using solid processing compositions, in which uneven developing (uneven density) and uneven drying (unevenness observed by reflection) are liable to be produced. The unevenness often occurs particularly when ingredients leached out of processed materials accumulate in the solution during the running process, or when the solution in a processing bath is allowed to partially evaporate and becomes concentrated in the running process over a long period of time. Occurrence of the unevenness is dependent on the kind of photographic materials (such as hardening property, developability, fixability and the binder content), but it is supposed that when transported through the racks of an automatic processor, the photographic material slips on the rollers and is scratched or causes oscillation during transportation, resulting in uneven developing, in which unevenness tends to increase in proportion to the slipping extent.

With regard to the uneven developing and uneven drying, the inventor of the present invention noted supports used in photographic materials, and as a result of his study, the use of a support comprised of a polyester mainly comprised of naphthalene-di-carboxylic acid and ethylene glycol, led to surprisingly and unexpectedly improved results in the unevenness.

SUMMARY OF THE INVENTION

Accordingly, an objective of the present invention is to provide a method for processing a silver halide black-and-white photographic light sensitive material, in which no slipping on a transport roller occurs, leading to prevention of uneven developing and uneven drying.

The above objective of the invention can be accomplished by the following constitution:

(1) a method for processing a silver halide black-and-white photographic light sensitive material comprising a transparent polyester support having thereon hydrophilic colloid layers including a silver halide emulsion layer, by the use of an automatic processor, the method comprising the steps of developing with a developing solution, fixing with a fixing solution, washing or stabilizing, and drying, wherein the polyester support is comprised of a biaxially stretched polyester resin film mainly comprising a naphthalenedicarboxylic acid and a diol; the developing solution and the fixing solution being prepared by dissolving, in water, a solid developing composition and a solid fixing composition, respectively, (2) the solid developing composition or solid fixing composition is preferably in the form of a tablet, (3) the developing composition preferably contains a reductone, and (4) the polyester support preferably has a thickness of 50 to 130 m.

DETAILED DESCRIPTION OF THE INVENTION

The polyester film support used in the invention is comprised of a biaxially stretched polyester mainly comprising a naphthalene-dicarboxylic acid and a diol. The expression "polyester mainly comprising a naphthalenedicarboxylic acid and a diol" refers to a polyester having a naphthalene-dicarboxylic acid and a diol as main components. The polyester may be modified by another third component in an amount of not more than 10 mol % and preferably not more than 5 mol %.

The naphthalenedicarboxylic acid as a main component includes 2,6-naphthalenedicarboxylic acid and/or 2,7-naphthalene-dicarboxylic acid. Other dicarboxylic acids (as the third component) include terephthalic acid, isophthalic acid, phthalic acid, diphenylsulfonedicarboxylic acid, diphenyl ether dicarboxylic acid, diphenylethanedicarboxylic acid, cyclohexanedicarboxylic acid, diphenyldicarboxylic acid, diphenyl thioether dicarboxylic acid, diphenylketone dicarboxylic acid and phenylindanedicarboxylic acid.

Examples of the diol include ethylene glycol, propylene glycol, tetramethylene glycol, cyclohexane-dimethanol, 2,2-bis(4-hydroxyphenyl)propane, 2,2-bis(hydroxyethoxyphenyl)-propane, bis(4-hydroxyphenyl) sulfone, bisphenolfluorenedihydroxyethyl ether, diethylene glycol, neopentyl glycol, hydroquinone, and cyclohexanediol.

Of these, in terms of transparency, mechanical strength and dimensional stability of the polyester, are preferable 2,6-naphthalenedicarboxylic acid, as a naphthalenedicarboxylic acid component; ethylene glycol and/or 1,4-cyclohexane-dimethanol, as a diol component; and terephthalic acid as a dicarboxylic acid of the third component. Specifically is preferred polyethylene 2,6-naphthalate, a polyester comprising 2,6-naphthalenedicarboxylic acid and ethylene glycol and further comprising terephthalic acid (as a third component), and a polyester comprised of a mixture of two or more above-described polyesters.

The polyester constituting the biaxially stretched polyester film may be copolymerized with another copolymerizing component or mixed with another polyester, unless deteriorated in effects.

The polyester used in the invention can contains an antioxidant. Specifically when the polyester contains a compound having a polyoxyalkylene group, the effect is marked. The antioxidant is not specifically limited and a variety of antioxidants can be employed. Examples of the antioxidant include hindered phenol compounds, phosphite compounds and thioether compounds. Of these are preferred hindered phenol compounds in terms of transparency. The antioxidant is contained preferably in an amount of 0.01 to 2 and more preferably 0.1 to 0.5% by weight, based on polyester. The content of the antioxidant within these range prevents so-called developer fog, in which a density of unexposed portion increases, and reduces haze of a film, leading to a photographic support with superior transparency. The antioxidant can be employed singly or in combination thereof.

To the biaxially stretched polyester film, lubricity can be optionally provided. A means for providing the lubricity is not limitative, including an external particle adding method in which inert inorganic particles are added into the polyester, an internal particle precipitating method in which catalyst added in synthesis of a polyester is allowed to be precipitated and a method in which a surfactant is coated on the film surface. Of these is preferred the internal particle precipitating method in which precipitated particles can be controlled to relatively small sizes and thereby the lubricity can be provided without deteriorating transparency. As a catalyst are usable a variety of known catalysts, and the use of Ni or Mn is preferable, resulting in high transparency. The catalyst can be used singly or in combination thereof.

A method for synthesizing the polyester used in the biaxially stretched polyester film is not specifically limited and the polyester can be synthesized in accordance with conventional methods. There can be employed, for example, a direct esterification method in which a dicarboxylic acid component is subjected to direct esterification reaction with a diol component and an ester exchange method in which a dialkyl ester, as a dicarboxylic acid component is subjected to ester exchange reaction with a diol component to complete polymerization by removing the diol in excess and a simultaneously formed alcohol under reduced pressure. In this case, a catalyst for ester exchange reaction or polymerization, or heat-resistant stabilizer can be optionally employed. Furthermore, there can also be incorporated an anti-coloring agent, antioxidant, nucleation-accelerating agent, lubricant, stabilizer, anti-blocking agent, UV absorbent, viscosity adjusting agent, defoaming agent, antistatic agent, pH adjusting agent, dye or pigment can also be incorporated at each step of synthesis.

The thickness of the biaxial stretched polyester film is not specifically limited and can be designed so as to have strength necessary for meeting a usage object. In the case when used in photographic material for medical use or lithographic use, the thickness is preferably 50 to 300 $\mu$m and more preferably 80 to 200 $\mu$m. In the case of being thinner than this range, necessary strength can be obtained; and in the case of being thicker, roll-set curl becomes larger. To display effects of the invention, the thickness of the biaxially stretched polyester film is preferably 50 to 130 $\mu$m. It is contemplated that stiffness and bending strength of the film are well balanced within this range of thickness and therefore, an approaching angle of the film to the transport roller is adjusted to become hard to be slipped. In the case of X-ray photographic films, there is difference in blur due to cross-over light and it is preferable for sharpness.

The haze of the biaxially stretched polyester film is preferably 3% or less and more preferably 1% or less. When the haze exceeds 3%, images are blurred and become unsharp. The haze can be measured in accordance with ASTM-D1003-52.

The glass transition point (Tg) of the biaxially stretched polyester film used in the invention is preferably 60° C. or higher. Tg can be defined as a mean value between a temperature at which the differential curve measured by a differential scanning calorimeter (DSC) begins to degrade from the base line and a temperature at which it comes back to the base line. When the Tg is higher than this value, there is no deformation of the film in the drying step of an automatic processor, and there can be obtained a photographic material with little roll-set curl.

Next, a method for manufacturing polyester films relating to the invention will be explained. Unstretched film sheets and uniaxially stretched film sheets can be prepared according to methods known in the art. For example, raw polyester material is molded into the a pellet form, and after being subjected to hot-air drying or vacuum drying, the polyester is extruded in a sheet form from a T-die through the melt extrusion method, brought into contact with a cooling drum by the electrostatic-application method and cooled to obtain an unstretched sheet. The resulting unstretched sheet is heated to the temperature within the Tg range of the polyester and Tg+10° C. through a heating means such as plural rollers and/or infra-red heater and is stretched in single or multiple steps in the longitudinal direction. The stretching magnitude is conventionally within a range of 2.5 to 6 times, which allows for the subsequent lateral stretching. In the case of a multi-layered sheet, the stretching temperature is preferably set, based on the highest Tg among the Tgs of each layer. In this case, the polyester is laminated in the method known in the art. Examples thereof include an co-extrusion method by using plural extruding machines and feed-block type die or multi-manifold type die, extruding lamination method in which other resin(s) constituting the laminate are extruded by melt extrusion on a single layer film or laminated film and are allowed to cool and solidify on a cooling drum and a dry-lamination method in which a single layer film or laminated film is further laminated by using an anchoring agent or adhesive. Of these methods, preferable is the co-extrusion method since it requires less manufacturing steps and exhibits superior interlayer adhesion.

The thus longitudinally, uniaxially stretched polyester film is further stretched in the lateral direction within a temperature range of Tg to Tm−20° C. and then thermally fixed. The lateral stretching magnitude is conventionally within the range of 3 to 6 times, and the longitudinal/lateral stretch ratio is optimally adjusted so that the resulting biaxially stretched film has preferred physical properties. In the invention, the elastic modulus in the lateral direction is adjusted to be larger than that in the longitudinal direction. Variations may be made corresponding to the usage of the polyester film. When two or more separated stretched portions are laterally stretched with heating within a temperature difference range of 1 to 50° C., fluctuation of physical properties in the lateral direction is preferably reduced. Moreover, after being laterally stretched, when the film is held at a temperature within a range of not more than a final lateral stretching temperature and not less than Tg−40° C. for 0.01 to 5 min., the fluctuation of physical properties in the lateral direction is preferably further reduced.

Thermal-fixing is performed at a temperature not lower than the final lateral stretch temperature and not more than Tm−20° C. for a period of 0.5 to 300 sec. In this case, two or more separate portions are thermally fixed while heating within a temperature difference range of 1 to 100° C. The thermally fixed film is cooled to a temperature of Tg, and after clip-held portions of both ends are cut off, the film is wound on reels, whereon it undergoes relaxation treatment of 0.1 to 10% at a temperature of not more than the final thermal-fixing temperature and not less than Tg, and in both the lateral and/or longitudinal directions. It is preferred to gradually cool the film at a rate of 100° C. or less per sec. within the range of the final thermal-fixing temperature and Tg. Means for cooling and the relaxation treatment are not specifically limited, but any means known in the art can be applied. It is preferred to conduct these treatments with cooling within plural temperature ranges, in terms of enhancement of dimensional stability of the film. The cooling rate is defined as (Tl−Tg)/t, where Tl is the final thermal-fixing temperature and t is the time necessary to reach Tg from the final thermal-fixing temperature. Optimal conditions for thermal-fixing, cooling and relaxation are dependent of the polyester constituting the film and adjusted so as to attain preferable physical properties.

In the manufacture of the afore-mentioned film, there may be provided , before and/or after stretching, an additional functional layer such as an antistatic layer, lubrication layer, adhesion layer, or barrier layer, for which a variety of surface treatments such as corona discharge treatment and chemical solution treatment are optionally performed. Further, to enhance strength, there can be conducted stretching methods commonly employed for stretched films, including multi-stage longitudinal stretching, longitudinal re-stretching, longitudinal and lateral re-stretching and lateral-longitudinal stretching. The cut-off clip-held portions of both ends are pulverized or optionally subjected to granulation, depolymerization or repolymerization, and reused as raw material for subsequent film manufacture.

The thus prepared biaxially stretched polyester film becomes quite resistant to roll set curling. This is contemplated to be due to an amorphous portion of polyester, irrespective of Tg, which aggregates over a long period of time to form fibril-form ribbons of spherulite-constituting elements, and it is stabilized in the form in which it is allowed to stand. [P. H. Gell et al., J. Macromol. Sci. Phys., Bl, 235, 251 (1967)]. This phenomenon can be observed in the DSC measurement, wherein the endo-thermic peak which is not observed immediately after film-forming, increases over time, and becomes resistant to roll set curl in proportion thereto. When the temperature is raised within the range lower than Tg and treatment time is shortened, nearly identical effects are also obtained, and the endothermic peak is shifted to the higher temperature range, based on treating temperature. In this case, when heated to a temperature higher than Tg, molecules in the amorphous portion begin to migrate to the rupture micro-fibrils, roll set curl resistance tendency is decreased.

The glass transition temperature can be determined in the following manner. A film sample of 10 mg is melted at 300° C. in nitrogen gas flow at a flowing rate of 300 ml/min. and immediately cooled. The sample is set in a differential scanning calorimeter (DSC type 8230, produced by Rigaku Denki) and Tg and Tc are measured with increasing the temperature at a rate 10k C/min. in nitrogen gas flow at a flowing rate of 100 ml/min. Tg is defined as an intermediate value between the temperature of rising from the base-line and the temperatire of returning the base-line. Measurement starts at a temperature by 50° C. or more lower than Tg.

When thermal treatment is conducted at lower temperature, longer time is required to reduce roll set curl so that it is difficult to continuously manufacture and deteriorates in manufacturing efficiency. When the thermal treatment temperature is too high, reduction of the roll set curl cannot be attained. The thermal treatment temperature is preferably from Tg+5° C. to Tg+25° C. In cases where a film is multi-layered, the temperature is based a polyester with the highest Tg among polyesters of layers contributing to rididity of the film.

The thermal treatment time may be the time enough for the film to be heated and conventionally not less than 0.01 sec. Reduction effect of the roll set curl by thermal treatment is saturated up to about 6 min. To accelerate the effect, it is preferred to conduct thermal pretreatment at 130+10° C. over a period of 0.01 to 30 min. and preferably not less than 0.01 min. and less than 6.min. in terms of continuous manufacturing.

The thermal treatment method usable in the invention is not limited and one in which the film can be uniformly heated at a short time as possible. Examples thereof include the method in which the film is allowed to transport by means of holding both ends with pins or clip, roller transport with plural rollers or air transport, and hot air is allowed to be blown ,through plural slits, onto one side or both sides, a method employing radiation such as infrared ray and a method of bringing into contact with plural heated rollers.

Since the thermal treatment temperature is higher than Tg, when the film is treated in the form of being wounded in one direction, it gets into a habit of the winding state. Therefore, it is preferable to subject tot the thermal treatment with keeping the film flat. To make curl-ballancing with photographic emulsion layer(s) of the final photographic material, an optimal roll set curl can be provided by allowing to be passed through curved surfaces using heated rollers or air transport.

Next, the processing method of the invention for a silver halide black-and-white photographic light sensitive material will be described below. As a developing solution and a fixing solution used in the processing method of the invention are employed those which prepared by dissolving solid processing composition(s) in water.

The solid processing composition may be in the form of powder, granules or a tablet. Of these, the tablet-form is preferable. The use of the processing composition in a tablet form results in reduction of processing unevenness occurred when processed at a low replenishing rate or continuously over a long period of time. This may be attributed to the fact that; since a speific component such as a binder is different in different solid states, the formula is suited for the form.

A solid developing composition used in the invention preferably contains a reductone. Specifically, uneven development can be improved by containing the reductone. It is contemplated that this is due to enhanced developability by action of the reductone as a reducing agent. The use of the reductone also leads to an improvement in storage stability of the solid developing composition. In cases where the reductone is employed as a developing agent, it is preferable that a developing solution is substantially free from hydroquinone. Further, in the processing method of the invention, the replenishing rate of a processing solution (developing solution or fixing solution) is preferably 200 ml/$m^2$ or less.

Reductones used in the invention include ene-diol type, enamyl type, ene-diamine type, thiol-enol type and enamine-thiol type. Of these, compounds represented by formulas (A) and A'-1 to A'-4 are preferred.

Formula (A)

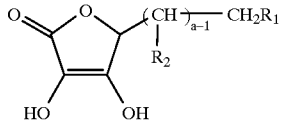

wherein $R_1$ represents a hydrogen atom or hydroxy group; $R_2$ represents a hydroxy group or a lower alkyl group (preferably having 1 to 4 carbon atoms); and a is an integer of 1 to 4. Exemplary examples thereof are shown below.

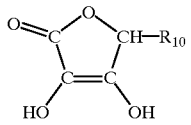

| | $R_{10}$ |
|---|---|
| A-1 | $-CH(OH)CH_2OH$ |
| A-2 | $-CH(OH)-CH(OH)CH_2OH$ |
| A-3 | $-CH(OH)CH_3$ |
| A-4 | $-CH(OH)-CH(OH)CH_3$ |
| A-5 | $-CH_2OH$ |
| A-6 | $-CH_3$ |
| A-7 | $-CH(OH)-CH(OH)-CH(OH)-CH_2OH$ |
| A-8 | $-CH(OH)-CH(OH)-CH(OH)-CH_3$ |
| A'-1 | 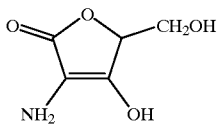 |
| A'-2 | 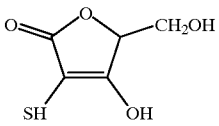 |
| A'-3 | 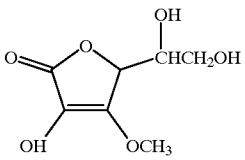 |

-continued

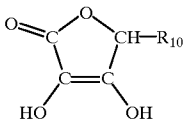

| | $R_{10}$ |
|---|---|
| A'-4 | 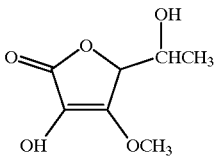 |

The reductone can also be used in the form of a alkali metal salt, such as lithium salt, sodium salt, or potassium salt. Of the above-described reductons are more preferable ascorbic acid and erythorbic acid represented by formula A-1. The reductone is used preferably in an amount of 3 to 80 g/l. In the case when used as a developing agent, it is preferably 25 to 50 g/l.

The developing solution prepared by dissolving the solid developing composition in water has preferably a pH of 9.0 to 11.0 and more preferably 9.5 to 10.5. In cases where the reductone is contained, the pH of the developing solution is still more preferably 9.5 to 10.0.

The developing solution is preferably substantially free from a dihydroxybenzene such as hydroquinone. The expression, "substantially free from a dihydroxybenzene" means to contain $5\times10^{-4}$ mol or less per liter. The developing solution used in the invention more preferably contains no dihydroxybenzene.

The developing solution preferably contains glutar aldehyde or a bisulfite adduct thereof. The developing solution preferably contains iodide ion in an amount of $2\times10^{-4}$ to $2\times10^{-3}$ mol/l. Incorporation of the iodide ion enhances covering power (CP). In the case when the reductone is contained, its effect is highly displayed.

The developing solution further contains a buffering agent, such as boric acid, a benzoate, alkanol amine, a phosphate, a bicarbonate and a carbonate. Of these is preferred a carbonate. The content of the buffering agent is preferably 0.35 mol or more per liter and more preferably 0.50 to 1.00 mol/l. Of carbonates and bicarbonates is preferable potassium carbonate or potassium bicarbonate. The potassium salt is more effective with respect to stability of the maximum density(Dm) and contrast (γ) than sodium or lithium salt. The developing solution may contain a chelating agent or biodegradable chelating agent, as disclosed in Japanese Patent Application No. 4-586232 (item 20). The developing solution may contain anti-slugging agent, such as compounds described in JP-A 7-13303 [formulas (1) and (2)]. The developing solution may contain a sulfite such as sodium or potassium sulfite, or a metabisulfite. The sulfites is used as a preservative and the content thereof is preferably 0.01 to 0.3 mol/l and more preferably 0.05 to 0.20 mol/l. The developing solution may contain a developing accelerator, such as thioether compounds, p-phenylenediamine compounds, quaternary ammonium compounds, amine compounds, polyalkyleneoxide compounds, and hydrazines. Potassium bromide or organic restrainers are employed as a restrainer. Examples thereof include N-containing heterocyclic compounds, such as benzotriazole, 6-nitrobenzoimidazole, 5-nitro-benzoindazole, 5-methylbenzotriazole, 5-nitrobenzotriazole, 5-chlorobenzotrizole, 2-thiazolyl-benzotriazole, azaindenes, adenine, and thiadiazole. A cyclodextrin is also preferably contained in the developing solution to enhance antioxidative property or improve silver image tone.

In the invention, a developing solution and a fixing solution can be prepared by dissolving in water, a pacaged solid processing (developing or fixing) composition. Pacaging the solid processing composition leads to not only enhancement of storage stability (variation of components or composition over a long period of storage) but also shortening of space.

To avoid concentration due to vaporization, it is preferable to replenish water to the developing solution and fixing solution.

The developing temperature is preferably 25 to 50° C. and more preferably 30 to 40° C. The developing time is preferably 5 to 25 sec. and more preferably 5 to 15 sec. The fixing temperature is preferably 25 to 50° C. and more preferably 30 to 40° C. The fixing time is preferably 5 to 25 sec. and more preferably 5 to 15 sec. The total processing time including developing, fixing , washing and drying steps (Dry to Dry) is preferably 30 120 sec. and more preferably 15 to 40 sec.

It is preferable to add to the developing solution, prior to processing. The starter is preferably in solid form. In the starter is employed an organic acid such as polycarboxylic acid, alkali metal halide such as KBr, organic restrainer, or developing accelerator.

Besides the reductone, an auxiliary developing agent may be contained in the developing solution, including 3-pyrazolidones [e.g., 1-phenyl-3-pyrazolidone, 1-phenyl-5-methyl-3-pyrazolidone, 1-phenyl-4-ethyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone, 3-acetoxy-1-phenyl-3-pyrazolidone, etc.], 3-aminopyrazolines [e.g., 1 -(p-hydroxyphenyl)-3-aminopyrazoline, 1-(p-methylaminophenyl)-3-aminopyrazoline, 1-(p-amino-m-methylphenyl)-3-aminopyrazoline, etc.] and phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoneamidoethylaniline, 3-methyl-4-amino-N-ethyl-N-β-methoxyethylaniline, etc.]. Of these are preferable 1-phenyl-3-pyrazolidones.

Aminophenols can also be used as an auxiliary developing agent. Examples thereof include 4-aminophenol, 4-amino-3-methylphenol, 4-(N-methyl)aminophenol, 2,4-diaminophenol, N-(4-hydroxyphenyl)glycine, N-(2'-hydroxyethyl)-2-aminophenol, 2-hydroxymethyl-4-aminophenol, 2-hydroxymethyl-4-(N-methyl)aminophenol, and their hydrochlorides or sulfates.

The auxiliary developing agent is contained preferably in an amount of 0.2 to 40 g and more preferably 0.5 to 25 g per liter of developing solution.

A fixing solution used in the invention is preferably prepared through preparation of a solid fixing composition and its dissolution in water. Thiosulfates are preferably used as a fixing agent. Examples of the thiosulfates include a lithium, potassium, sodium or ammonium thiosulfate. Of these are preferred ammonium thiosulfate and sodium thiosulfate to obtain a fixing solution with a high fixing speed.

Iodides or thiocyanates are also usable as the fixing agent. The fixing solution contains a sulfite. The sulfites include a lithium, potassium, sodium or ammonium sulfite.

The fixing solution may contain a water soluble chromium salt or aluminum salt. Examples of the water soluble chromium salt or aluminum salt include chromium alum, aluminum sulfate, potassium aluminum chloride, aluminum chloride.

The fixing solution may contain an acetate ion. The acetate ion is optionally usable and acetic acid and a lithium, potassium, sodium or ammonium acetate are preferably used. Of these, sodium or ammonium acetate is particularly preferred. As a buffer can be used β-alanine or succinic acid.

Furthermore, citric acid, tartaric acid, malic acid, succinic acid, phenylacetic acid or an optical isomer thereof may be contained. There is also usable a lithium, potassium, sodium or ammonium salt, such as potassium citrate, lithium citrate, sodium citrate, ammonium citrate, lithium tartarate, potassium tartarate, sodium hydrogentartarate, sodium tartarate, ammonium tartarate, ammonium hydrogentartarate, ammonium potassium tartarate, sodium potassium tartarate, sodium malate, ammonium malate, sodium succinate and ammonium succinate. Of these compounds are preferred citric acid, isocitric acid, malic acid, phenylacetic acid and salts thereof. As other acids, inorganic acids such as sulfuric acid, hydrochloric acid, nitric acid and boric acid and organic acids such as formic acid, propionic acid, oxalic acid and malic acid are each usable. Boric acid and aminopolycarboxylic acids are preferably used.

Aminopolycarboxylic acid such as nitrilotriacetic acid and ethylenediaminetetraacetic acid and salt thereof are used as a chelating agent. An anionic surfactant such as sulfuric esters and sulfonates, polyethylene glycol-type or ester-type nonionic surfactant, and amphoteric surfactant are used as a surfactant. As a lubricant is cited an alkanolamine or an alkylene glycol. As a fixing accelerator are cited thiourea derivatives, an alcohol having a triple bond and thioethers. The pH of the fixing solution is 3.8 or more and preferably 4.2 to 5.5.

Next, solidification of the processing composition will be described. The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer, as described in JP-A 4-29136, 4-85533, 4-85534, 4-85535, 4-85536 and 4-172341. A preferred tablet-making process is to form a tablet by compression-molding after granulating powdery processing composition. As compared to a solid composition prepared simply by mixing the processing composition to form a table, there is an advantage that improvements in solubility and storage stability were achieved and resultingly, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 μm and preferably 200 to 750 μm. In particular, 60% or more of the granules is with a deviation of ±100 to 150 μm. When the grain size smaller, it tends to cause localization of mixing elements and therefore, is undesirable. As hydraulic press machine, any conventional compression molding machine, such as a single-engined compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The processing composition in the form of a tablet can be prepared according to methods, as described in JP-A 51-61837, 54-155038, 52-88025, and British Patent 1,213,808. The granular processing composition can also be prepared according to methods. as described in JP-A 2-109042, 2-109043, 3-39735 and 3-39739. The powdery processing composition can be prepared according to methods, as described in JP-A 54-133332, British Patent 725,892 and 729,862 and German Patent 3,733,861.

In cases where the solid processing composition of the invention, its bulk density is preferably 1.0 to 2.5 g/cm$^3$ from the viewpoint of solubility and the point of effects of the invention. When being not less than 1.0 g/cm$^3$, it is advantageous for strength of the solid composition; and when being not more than 2.5 g/cm$^3$, it is advantageous for solubility. In cases where the composition in the form of granules or powder, the bulk density is preferably 0.40 to 0.95 g/cm$^3$.

A processing chemical having at least a part solidified and a solid processing chemical each applicable to the invention are included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

It is preferable that all the processing chemicals are solidified and are then replenished to the corresponding processing tanks so as to meet the information on a processing amount. When an amount of replenishing water is required, it is replenished in accordance with an information on a processing amount or another information on the replenishing water control. In this case, the liquids to be replenished to a processing tank can only be replenishing water. In other words, when a plurality of processing tanks are required to be replenished, the tanks for reserving some replenishing liquids can be saved to be only a single tank by making use of replenishing water in common, so that an automatic processor can be made compact in size. In particular for making the automatic processor compact in size, it is preferable to put a water replenishing tank to the outside of the automatic processor.

A preferable embodiment of a solid processing chemical applicable to the invention is that all of an alkali agent, a developing agent and a reducer are solidified when solidifying a color developer, and that, when a color developer is tableted, the numbers of the tablets may be not more than 4 tablets and, preferably, a single tablet. When the solid processing chemicals are solidified separately into not less than 2 tablets, it is preferable to pack these plural tablets or granules in the same package.

A moisture-proofed package for tablets or pills may be embodied of such a raw material as given below.

As for a synthetic resin material, any one of the following materials may be used; namely, polyethylene (including any one prepared in either a high-pressure method or a low-pressure method), polypropylene (either non-stretched or stretched), polyvinyl chloride, polyvinyl acetate, Nylon (either stretched or non-stretched), polyvinylidene chloride, polystyrene, polycarbonate, Vinylon, Evarl, polyethylene terephthalate (PET), other polyesters, rubber hydrochloride, an acrylonitrile-butadiene copolymer and an epoxy-phosphoric acid type resin (a polymer described in JP OPI Publication Nos. 63-63037/1988 and 57-32952/1982), or pulp.

The films of the above-given materials are usually made adhered to each other so as to be laminated. However, these materials may also be formed into a coated layer.

It is further preferable to provide a gas-barrier layer thereto. For example, an aluminium foil or an aluminium vacuum-evaporated synthetic resin is sandwiched between the above-mentioned synthetic resin films.

A total oxygen permeability of the above-mentioned laminated layers is, preferably, not higher than 50 ml/m$^2$ 24 hr/atm (at 20° C. and 65% RH) and, more preferably, not higher than 30 ml/m$^2$ 24 hr/atm.

A photographic processing chemical packed, bound or covered by a water-soluble film or a binder is preferable to be packed in a moisture-resistive packaging material so as to be protected from a high moisture, a moisture in the air such as rain and mist, and an accidental damage produced by bringing the package into contacting with water by scattering water or by wet hand in the course of storing, transporting or handling the package. The moisture-resistive packaging materials include preferably a film having a thickness within the range of 10 to 150$\mu$. The material thereof is preferably at least a material selected from the group consisting of a polyolefin film such as those of polyethylene terephthalate, polyethylene and polypropylene, a sheet of craft paper capable of having a moisture-resistive effect displayable with polyethylene, waxed sheet of paper, moisture-resistive cellophane, glassine, polyester, polystyrene, polyvinyl chloride, polyvinylidene chloride, polyamide, polycarbonate, acrylonitrile and a metal foil such as those of aluminium, and a metallo- polymer. They may also be a compounded material of the above-given material.

In an embodiment of the invention, it is also preferable that a moisture-resistive material is made of a decomposable plastic including particularly a biodegradable or photolyzable plastic.

The biodegradable plastics include, for example, (1) those comprising a natural macromolecule, (2) a microbial growing polymer, (3) a synthetic polymer having a good biodegradation property, and (4) a compound of a biodegradable natural macromolecule to a plastic. The photolyzable plastics include, for example, (5) those having a group made present in the principal chain so as to be excited by UV rays and then coupled to a scission. Besides the above-given macromolecules, those having the two functions of a photolyzing and biodegrading properties at the same time may also effectively be used.

The typical and concrete examples thereof may be given as follows.

The examples of the biodegradable plastics may be given as follows;

(1) Natural macromolecules, namely, polysaccharide, cellulose, polylactic acid, chitin, chitosan, polyamino acid, and the modified thereof;

(2) Microbial growing polymers, namely, "Biopol" comprising PHB-PHV (that is a copolymer of 3-hydroxybutylate and 3-hydroxybarrelate), and microbial growing cellulose;

(3) Biodegradable synthetic polymer, namely, polyvinyl alcohol, polycaprolactone and the copolymer or mixture thereof;

(4) Compound of a biodegradable natural macromolecule to a plastic, namely, natural macromolecule having a good biodegradation property such as starch and cellulose, which is added to a plastic so that a configuration decaying property can be provided to the plastic.

(5) Photo-decomposable plastics, namely, those introduced thereinto with a carbonyl group for providing a photodecaying property, and those added thereto with a UV absorbent for accelerating a decaying property.

As for such a decomposable plastics as mentioned above, those publicly described in, for example, "Chemistry and Industry", Vol. 64, No. 10, pp. 478–484, (1990); "The Kino Zairyo", July, 1990 Issue, pp. 23–34; may be used. Besides the above, it is also allowed to use the decomposable plastics available on the market, such as Biopol (manufactured by I.C.I.), Eco (manufactured by Union Carbide Corp.), Ecolite (manufactured by Eco Plastics, Inc.), Ecostar (manufactured by St.Lawrence Starch Co.) and Nackle P (manufactured by Japan-Unicar, Inc.).

The above-mentioned moisture-proofed packaging materials are to have a moisture permeability coefficient of not higher than 10 $g \cdot mm/m^2 \cdot 24$ hr and, preferably not higher than 5 $g \cdot mm/m^2 \cdot 24$ hr.

As for the means for supplying a solid processing chemical to a processing tank in the invention, and in the case where the solid processing chemical is of the tablet type, for example, there are such a well-known means as described in Japanese Utility Model OPI Publication Nos. 63-137783/1988, 63-97522/1988 and 1-85732/1989, wherein, in short, any means may be used, provided that at least a function for supplying a tableted chemical to a processing tank can be performed. And, in the case where the solid processing chemical is of the granulated or powdered type, there are such a well-known means such as the gravity dropping systems described in JP OPI Publication Nos. 62-81964/1987, 63-84151/1988 and 1-292375/1989, and the screw system described in JP OPI Publication Nos. 63-105159/1987 and 63-84151/1988. However, the invention shall not be limited to the above-given well-known means.

Among them, however, a preferable means for supplying a solid processing chemical to a processing tank is such a means, for example, that a prescribed amount of a solid processing chemical is weighed out in advance and is then separately packed and the package thereof is opened and the chemical is then taken out of the package so as to meet the quantity of light-sensitive materials to be processed. To be more concrete, every prescribed amount of a solid processing chemical and, preferably, every amount for a single replenishment is sandwiched between at least two packing materials constituting a package. When separating the package into two directions or opening a part of the package, the solid processing chemical can be ready to take out thereof. The solid processing chemical ready to be taken out thereof is readily be supplied to a processing tank having a filtration means by naturally dropping the chemical. The prescribed amounts of the solid processing chemicals are each separately packed respectively in a tightly sealed package so as to shut off the open air and the air permeability to any adjacent solid processing chemicals. Therefore, the moisture resistance can be secured unless the packages are opened.

In an embodiment of the invention, it may be to have a constitution in which a package comprising at least two packing materials sandwiching a solid processing chemical therebetween is brought into close contact with or made adhered to the peripheries of the solid processing chemical on each of the contacting surfaces of the two packing materials so as to be separable from each other, if required. When each of the packing materials sandwiching the solid processing chemical therebetween is pulled each to the different directions, the close contacted or adhered surfaces are separated from each other, so that the solid processing chemical can be ready to take it out.

In another embodiment of the invention, it may be to have the following constitution. In a package comprising at least two packing materials sandwiching a solid processing material therebetween, at least one of the packing materials thereof can be ready to open the seal by applying an external force. The expression, "to open a seal", stated herein means that a packing material is notched or broken off as a part of the packing material remains unnotched or unbroken off. It may be considered to open a seal in such a manner that a solid processing chemical is forcibly extruded by applying a compression force from the side of a packing material subject to be unopened through a solid processing chemical to the direction of a packing material made ready to be opened, or that a solid processing chemical can be ready to take out by notching a packing material subject to be opened by making use of a sharp-edged member.

A supply-starting signal can be obtained by detecting an information on a processing amount. Based on the obtained supply-starting signal, a driving means for separation or opening a seal is operated. A supply-stopping signal can be obtained by detecting an information on the completion of a specific amount of supply. Based on the obtained supply-stopping signal, a driving means for separation or opening a seal is so controlled as to be stopped in operation.

The above-mentioned solid processing chemical supplying means has a means for controlling the addition of a specific amount of the solid processing chemical, that is an essential requirement for the invention. To be more concrete, in an automatic processor of the invention, these means are required to keep every component concentration constant in each processing tank and to stabilize every photographic characteristic. The term, "an information of the processing amount of silver halide photographic light-sensitive materials", means an information on a value obtained in proportion to an amount of silver halide photographic light-sensitive materials to be processed with a processing solution, to an amount of silver halide photographic light-sensitive materials already processed or to an amount of silver halide photographic light-sensitive materials being processed, and the values indicate indirectly or directly an amount of a processing chemical reduced in a processing solution. The values may be detected at any point of time before and after a light-sensitive material is introduced into a processing solution or during the light-sensitive material is dipped in the processing solution. An amount of a light-sensitive material printed by a printer may also be detected for this purpose. A concentration or concentration variation of a processing solution reserved in a processing tank may further be detected. An amount discharged to the outside after a processing solution is dried up may also be detected.

A solid processing composition of the invention may be added to any position inside a processing tank and, preferably, to a position communicated with a section for processing a light-sensitive material and circulating a processing solution between the processing tank and the processing section. It is also preferable to have such a structure that a certain amount of processing solution can be circulated therebetween so that a dissolved component can be moved to the processing section. It is further preferable that a solid processing chemical is added to a thermostatically controlled processing solution.

Generally in an automatic processor, the temperature of a processing solution loaded therein is controlled by an electric heater. As for a general method thereof, a heat exchanger section is provided to an auxiliary tank connected to a processing tank and a heater is also provided thereto, and a pump is further arranged so as to circulate a given amount of the solution from the processing tank to the auxiliary tank and keep the temperature constant.

For the purpose of removing a crystallized foreign substance contained in a processing solution or produced in a crystallization, a filter is usually arranged.

It is allowed to connect a replenishing tank to a section connected to a processing section, such as the above-mentioned auxiliary tank.

All materials of the filters, filtration devices and so forth applicable to any ordinary automatic processors can also be used in the invention, and a specific structures and materials shall not affect the effects of the invention.

In the invention, the circulation frequency of a processing solution circulated by a circulation means is to be within the range of, 0.5 to 2.0 times/minute, preferably 0.8 to 2.0 times/minute and more preferably 1.0 to 2.0 times/minute. The expression, "a circulation frequency", herein is related to a flow rate of a liquid to be circulated, and one circulation herein means when a liquid amount corresponding to the total liquid amount reserved in a processing tank is flowed out. The solid processing composition is added to the processing tank, separately from the replenishing water. The replenishing water is supplied from the water storage tank.

Now, an antimolding means of a water replenishing tank of an automatic processor relating to the invention will be detailed. When a liquid exchange rate of a water replenishing tank is lowered so that a water retention time is prolonged, there raises such a problem that a fur is produced and a bad smell is also produced after 2 to 3 weeks, because water contained in the tank is spoilt. If a fur produced is replenished as it is, there raises such a serious problem that the fur adheres to a photographic material so that a development unevenness is produced when the fur adheres to a developing tank, and a fixing failure is produced so that the commercial value is seriously spoilt when the fur adheres to a fixing tank. Therefore, every tank is to be cleaned up periodically for removing a fur, so that it takes much time and requires much labor. Therefore, a water supplying tank of the invention has and antimolding means. The antimolding means can be achieved by at least one means selected from the group consisting of the following means.

1) A chelating agent adding means,
2) An antimold adding means,
3) A deionizing means,
4) A UV-ray irradiating means,
5) A magnetic treating means,
6) A supersonic treating means,
7) An electrolytic pasteurizing means,
8) A silver-ion releasing means,
9) An air bubbling means,
10) An active oxygen releasing means,
11) A means for coming into contact with a porous material,
12) A means for adding other harmless fungus to prevent any multiplication of harmful fungi.

Now, the above-mentioned means will concretely be detailed. As for the chelating agents and pasteurizers applicable to serve as an antimolding means in the invention, the following compounds can be used for example.

The chelating agents preferably applicable to the invention include, for example, ethylenediamine tetraacetic acid, diethylenetriamine pentaacetic acid, 1-hydroxyethylidene-1, 1-diphosphonic acid, ethylenediamine tetra(methylene phosphonic acid), 2-hydroxy-4-sulfophenol and 2-hydroxy-3,5-disulfophenol. The pasteurizers include, for example, a phenol type compound, a thiazole type compound and a benztriazole type compound. To be more concrete, the preferable compounds thereof include, for example, 1,2-benzisothiazoline-3-one, 2-methyl-4-isothiazoline-3-one, 2-octyl-4-isothiazoline-3-one, 5-chloro-2-methyl-isothiazoline-3-one, Sodium O-phenylphenol and benztriazole. When these compounds are collectively packed in one lot, they are preferable to be in the tablet form. When they have been dividedly weight in advance, they are preferable to be packed individually in an amount for a single usage.

As for the means for adding the chelating agent and pasteurizer, it is allowed that a chemical preparator may add them by hand. It is however preferable that a solid processing composition supply device is provided and they may be added thereby, and it is more preferable that a detector is provided to a water replenishing tank and they are automatically added when water is replenished up to a certain level of the tank, from the viewpoint of maintenance-free.

The solid processing composition used in the invention preferably contain a saccharide and/or a compound represented by the following formulas (B), and a compound represented by formula (C). The saccharide(s) are contained preferably in an amount of not less than 0.5% and less than 30%, more preferably, not less than 3% and less than 20%, based on the weight of the solid processing composition.

The saccharides in the invention refer to monosaccharides or polysaccharides in which monosaccharides are combined with each other through a glycoside bond including a derivative thereof or a decomposition product thereof.

Monosaccharides refer to as a polyhydroxy aldehyde, polyhydroxy ketone and their derivatives such as reduction derivatives, oxidation derivatives, deoxy-derivatives, amino-derivatives or thio-derivatives. Most of them are represented by the general formula $C_n'(H_2O)m'$. The monosaccharide in the invention includes a compound derived from saccharide skeleton. represented by the above formula. The preferable is a sugar alcohol having a primary or secondary alcohol group to which an aldehyde or ketone group is reduced.

Polysaccharides include celluloses, starches or glycogens. The celluloses include derivatives such as cellulose ethers in which all or a part of hydroxy group are etherified, and starches include maltose or dextrins that starches are hydrolyzed to various decomposition compounds. Celluloses may be in an alkali salt form in view of solubility. Among polysaccharides, celluloses or dextrins are preferably used, and dextrins are more preferably used.

Examples of monosaccharides including a derivative thereof in the invention will be shown below.

Erithorit (produced by Mitsubishi Kasei Shokuhin Co. Ltd., Erythritol)
D-sorbitol
L-sorbitol
D-mannitol
L-mannitol
D-iditol
L-iditol
D-talitol
L-talitol Dulcitol Allodulcitol Examples of polysaccharides and their decomposition products will be shown below.

α-Cyclodextrin

β-Cyclodextrin

γ-Cyclodextrin

Hydroxypropyl-α-cyclodextrin

Hydroxypropyl-β-cyclodextrin

Hydroxypropyl-γ-cyclodextrin

Maltodextrin

The cyclodextrin used in the invention preferably has a weight-averaged molecular weight of 10 to 1000.

Saccharides exist widely in the nature, and are also commercially available. The derivatives thereof can be readily prepared by reduction, oxidation or dehydration reactions.

As starch compounds available on the market include Pineflow, Pine-dex series, Max 100, Glistar P, TK-16, MPD, H-PDX and Stuco-dex produced by Matsutani Kagaku Co., Ltd. or Oil Q series produced by Nihon Yushi Co., Ltd.

Next, a compound represented by formula (B) will be explained concretely as follows.

$$HO—(A_1—O)_{l1}-(A_2—O)_{l2}-(A_3—O)_{l3}—H \qquad \text{Formula (B)}$$

In the formula, $A_1$, $A_2$ and $A_3$ each represent a straight chained or branched alkylene group, which may be substituted and these may be either the same or different.

As a substituent, there may be given a hydroxy group, a carboxy group, a sulfonyl group, an alkoxy group, a carbamoyl group and a sulfamoyl group. Preferably, $A_1$, $A_2$ and $A_3$ are each an unsubstituted alkylene group. More preferably $A_1$, $A_2$ and $A_3$ each are $—CH_2CH_2—$ or $—CH(CH_3)—CH_2—$. $l_1$, $l_2$ and $l_3$ each represent 0 or integers of 1–500, provided that the total number thereof is equal to or larger than 5 ($l_1+l_2+l_3 \geqq 5$). Among the foregoing, preferably, at least one of $l_1$, $l_2$ and $l_3$ is 15 or more and more preferably, at least one of $l_1$, $l_2$ and $l_3$ is 20 or more.

When the compound represented by formula (B) is a copolymer in which two kinds of monomers A and B are copolymerized, those having configurations shown below are also included.

-A-B-A-B-A-B-A-B-A-B-

-A-A-B-A-B-B-A-A-A-B-A-A-B-B-A-

-A-A-A-A-A-A-B-B-B-B-B-B-A-A-A-A-A-

Among those copolymers is preferable a block polymer (nonionic polymer of a Pluronic type) of ethylene glycol and propylene glycol represented by the following Formula (B-1).

$$HO—(CH_2CH_2—O)_{l4}-[CH(CH_3)CH_2—O]_{l5}-(CH_2CH_2—O)_{l6}—H \qquad \text{(B-1)}$$

In the formula, $l_4$, $l_5$ and $l_6$ are the same as those defined in $l_1$, $l_2$ and $l_3$ in the afore-mentioned Formula (B).

In the compound represented by formula (B-1), it is preferable that the content (wt %) of ethyleneoxide in the total molecular weight is 70 wt % or more, and it is especially preferable that the content is 80 wt % or more.

Exemplary compounds represented by formula (B) and formula (B-1) are further shown below.

| HO—(CH$_2$—CH$_2$—O)n'—H | Average molecular weight |
|---|---|
| B-1 | 300 |
| B-2 | 600 |

-continued

| HO—(CH$_2$—CH$_2$—O)n'—H | Average molecular weight |
|---|---|
| B-3 | 1000 |
| B-4 | 1500 |
| B-5 | 2000 |
| B-6 | 3000 |
| B-7 | 4000 |
| B-8 | 6000 |
| B-9 | 10000 |
| B-10 | 15000 |
| B-11 | 20000 |
| B-12 | 30000 |

Compound, $HO—(CH_2CH_2—O)a'-[CH(CH_3)—CH_2—O]b'-(CH_2CH_2—O)c'—H$

| Compound, HO—(CH$_2$CH$_2$—O)a'—[CH(CH$_3$)—CH$_2$—O]b'—(CH$_2$CH$_2$O)c'—H | | |
|---|---|---|
| | Content (wt %) of ethyleneoxide in the total molecular weight | Average molecular weight |
| B-1-1 | 80 | 8350 |
| B-1-2 | 80 | 10800 |
| B-1-3 | 50 | 4600 |
| B-1-4 | 70 | 6500 |
| B-1-5 | 80 | 5000 |
| B-1-6 | 50 | 3500 |
| B-1-7 | 70 | 7850 |
| B-1-8 | 50 | 4150 |

In the above formulas, n' is an integer of 5 or more; and a', b' and c' have the same definitions as those of $l_1$, $l_2$ and $l_3$, respectively.

Among compounds represented by Formula (B) and Formula (B-1), the most preferable is polyethylene glycol (hereinafter referred to sometimes as PEG).

In the case of polyethylene glycol, those having an average molecular weight ranging from 2000 to 20000 are preferable, and especially preferable includes those having an average molecular weight ranging from 3000 to 15000.

The average molecular weight in the invention is a molecular weight determined based on a hydroxyl value. The compound represented by formula (B) may be used singly or in combination. The compound represented by formula (B) are contained preferably in an amount of not less than 0.1% and less than 10%, more preferably, not less than 0.1% and less than 5%, based on the weight of the solid processing composition.

A compound represented by formula (C) will be explained below.

$$R—SxOyM \qquad \text{Formula (C)}$$

In the formula, R represents an aliphatic group, an aromatic group or a heterocyclic group, x is 1 or 2, y is an integer of 2 to 8, and M represents a cation.

The solid processing composition relating to the invention contains an organic oxide compound represented by formula (C) in an amount of 0.01 to 3.0%, preferably, 0.1 to 2.5% and more preferably, 0.5 to 2.0% by weight of the solid processing composition.

In formula (C), the aliphatic group represented by R includes an alkyl group, an alkenyl group and an alkynyl group. Examples of the alkyl group includes methyl ethyl, i-propyl, butyl, t-butyl, pentyl, cyclopentyl, hexyl, cyclohexyl, octyl and decyl. The alkyl group may be substituted by a substituent, including a halogen atom (e.g., chlorine, bromine, fluorine), alkoxy group (e.g., methoxy, ethoxy, 1,1-dimethylethoxy, hexyloxy, dodecyloxy), aryloxy (e.g., pheoxy, naphthoxy), aryl group (phenyl naphthyl), alkoxycarbonyl group (e.g., methoxycarbonyl, ethoxycarbonyl, butoxycarbonyl, 2-ethylhexylcarbonyl), aryloxycarbonyl group (e.g., pheoxycarbonyl, naphthyloxycarbonyl), alkenyl group (e.g., vinyl, allyl, heterocyclic group (e.g., 2-piperidyl, 3-pyridyl, 4-pyridyl, morpholyl, piperazyl, pyrimidyl, pyrazolyl, furyl), alkynyl group (e.g., propargyl), amino group (e.g., amino, N,N-dimethylamino, anilino), cyano group, sulfonamido group (e.g., methysulfonylamino, ethylsulfonylamino, octylsulfonylamino, phenylsulfonylamino). The alkenyl group includes vinyl and allyl. The alkynyl group includes propargyl group.

The aromatic group represented by R includes, for example, a phenyl group or naphthyl group.

The heterocyclic group represented by R includes, for example, a pyridyl group (e.g., 2-pyridyl, 3-pyridyl, 4-pyridyl), thiazolyl group, oxazolyl group, imidazolyl group, furyl group, thienyl group, pyrrolyl group, pyradynyl, pyrimidinyl, pyridazinyl, selenazolyl, sulforanyl, piperidinyl, pyrazolyl tetrazolyl).

The above-described alkenyl group, alkynyl group, aromatic group and heterocyclic group represented by R may be substituted. Substituents are the same as those in the case of the alkyl group.

M is preferably a metal ion or an organic cation. Examples of the metal ion include lithium ion, sodium ion, potassium ion. The organic cation includes an ammonium ion (e.g., ammonium, tetramethylammonium, tetrabutylammonium, phosphonium ion (e.g., tetraphenylphosphonium) and guanidyl.

It was proved that, in the formation tablet by compression-molding of the inventive solid processing composition containing the saccharides and/or the compound of formula (B), incorporation of the compound represented by formula (C) led to improvements in lubricity, hardness of the tablet and abrasiveness.

The following examples are illustrative of the compound represented by formula (C), but are not to be construed as limiting the same.

| | |
|---|---|
| C-1 | $C_2H_5SO_3Na$ |
| C-2 | $CH_3(CH_2)_6SO_3Na$ |
| C-3 | $CH_3(CH_2)_7SO_3Na$ |
| C-4 | $CH_3(CH_2)_5OSO_3Na$ |
| C-5 | $CH_3(CH_2)_6OSO_3Na$ |
| C-6 | $CH_3(CH_2)_7OSO_3Na$ |
| C-7 | $CH_3O(CH_2)_2SO_3Na$ |
| C-8 | 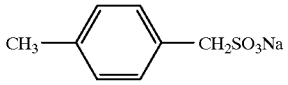 |
| C-9 | 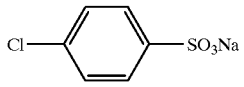 |
| C-10 | 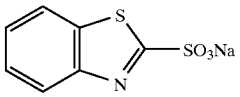 |

-continued

| | |
|---|---|
| C-11 | 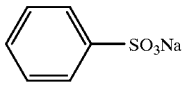 |
| C-12 | $CH_3(CH_2)_{10}CO-N(CH_3)CH_2CH_2SO_3Na$ |
| C-13 | $CH_3(CH_2)_{11}SO_3Na$ |

Any silver halide black-and-white photographic light sensitive material can be employed in the invention, if it meets requirements of the present invention. Silver halide grains contained in a silver halide emulsion layer are preferably tabular grains having an aspect ratio of 3 or more and more preferably 5 to 10. The silver halide grains are preferably chemical-sensitized with selenium or tellurium. With regard to the halide composition, any of silver chloroiodobromide, silver bromide, silver iodobromide, silver chloride and silver chlorobromide can be applicable. The iodide content of the silver halide grains is preferably not more than 1 mol % and more preferably not more than 0.5 mol %. This range of the iodide content is suitable for rapid processing systems (e.g., dry to dry of 30 sec.). A natural polymer such as dextran and/or synthetic polymer such as polyacrylamide may be contained in a silver halide emulsion layer and/or a hydrophilic colloid layer such as a protective layer or crossover-light shielding layer.

EXAMPLES

Embodiments of the present invention will be explained based on examples, but the invention is not limited to these examples.

Example 1

Preparation of support:

To 100 parts of dimethyl 2,6-naphthalenedicarboxylate and 60 parts of ethylene glycol was added a catalyst for ester exchange reaction to perform polycondensation. To resulting polyethylene 2,6-naphthalate was a blue dye, and an unstretched film was obtained by melt extrusion. The film was longitudinally stretched by 4.2 times at 170° C. and further latarally stretched by 4.2 times at 150° C.

Thermal-fixing was made at 255° C. for 10 sec. to obtain a polyester film with a thickness of 100 μm. There were thus obtained supports of polyethylene 2,6-naphthalate (herein after, denoted as PEN) with a thickness of 60 μm, 100 mm or 180 μm and a blue density of 0.17.

Comparative supports of polyethylene terephthalate (hereinafter, denoted as PET) with a thickness of 60 μm, 100 mm or 180 μm and a blue density of 0.17 were also prepared in a manner similar to the above, provided that dimethyl 2,6naphthalenedicarboxylate was replaced by dimethyl terephthalate.

Subbing treatment:

On both sides of the supports obtained was coated a lower sub-layer with the composition described below and further thereon was coated a upper sub-layer with the composition described below.

Lower sub-layer

| | |
|---|---|
| Latex 1 (St:EA = 15:85, Tg = −6° C.) | 200 m g/m$^2$ |
| Compound A | 5.0 m g/m$^2$ |
| Hexamethylene-1,6-bis(ethyleneurea) | 5.0 m g/m$^2$ |
| $SnO_2$ | 450 m g/m$^2$ |

Upper sub-layer

| | |
|---|---|
| Latex A (Tg = 55° C.) | 10 mg/m$^2$ |
| Compound L-1 | 30 g/m$^2$ |
| Compound A | 5.0 mg/m$^2$ |
| Acetic acid | 2.0 mg/m$^2$ |
| Silica (average particle size, 3 $\mu$m) | 3.0 mg/m$^2$ |
| Compound S | 5.0 mg/m$^2$ |

*Latex A was comprised of n-butyl acrylate (10), t-butyl acrylate (35), styrene (25) and hydroxyethyl methacrylate (30).

Compound L-1

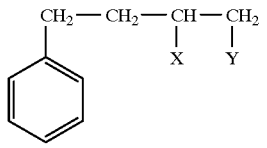

X:COOH or COONa
Y:COONa $COOCH_2CF_2CF_2H$

Compound A

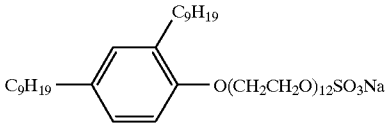

Compound S

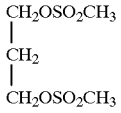

Preparation of photographic light sensitive material

First, a light-sensitive material for evaluation purpose was prepared in the following manner.

Preparation of light-sensitive material

Preparation of seed emulsion:

Seed emulsion-1 was prepared in the following manner.

| | | | |
|---|---|---|---|
| A1 | Ossein gelatin | 24.2 | g |
| | Water | 9657 | ml |
| | Sodium polypropyleneoxy-polyethyleneoxy-disuccinate (in an aqueous 10% ethanol solution) | 6.78 | ml |
| | Potassium bromide | 10.8 | g |
| | 10% nitric acid solution | 114 | ml |
| B1 | Aqueous 2.5N silver nitrate solution | 2825 | ml |
| C1 | Potassium bromide | 841 | g |
| | Add water to make | 2825 | ml |
| D1 | An aqueous 1.75N potassium bromide solution | | |
| | An amount for controlling the following silver potential | | |

To Solution A1, Solutions B1 and C1 were each added in an amount of 464.3 ml at 42° C. by making use of a mixing stirrer shown in examined and published Japanese Patent 58-58288 and 58-58289 in a double-jet process by taking 1.5 minutes, so that nucleus grains were formed.

After stopping the addition of Solutions B1 and C1, the temperature of Solution A1 was raised to 60° C. by taking 60 minutes and the pH thereof was adjusted to be 5.0 by making use of a 3% KOH solution. Thereafter, Solutions B1 and C1 were each added thereto again at a flow rate of 55.4 ml/min. for 42 minutes in the double-jet process. At the time for raising the temperature from 42° C. to 60° C. and the time for the subsequent double-jet process carried out with Solutions B1 and C1, the silver potential (measured by a silver-ion selection electrode together with a saturated silver-silver chloride electrode as a control electrode) was so controlled as to be +8 mv and +16 mv by making use of Solution D1, respectively.

After the completion of the addition, the pH was adjusted to be 6 with a 3% KOH solution and a desalting treatment were immediately made. The resulting seed emulsion was proved through an electron microscope as follows. Not less than 90% of the whole projected area of the silver halide grains thereof were comprised of hexagonal, tabular-shaped grains having the maximum adjacent edge ratio within the range of 1.0 to 2.0; and the average thickness and average grain-size (converted into the diameter of the corresponding circle, i.e., circle equivalent diameter) of the hexagonal tabular grains were proved to be 0.064 $\mu$m and 0.595 $\mu$m, respectively. Further, the variation coefficients of the grain thickness and the distance between the twin planes thereof were proved to be 40% and 42%, respectively.

Preparation of emulsions, Em-1 to Em-3:

By making use of Seed emulsion-1 and the following 4 kinds of solutions, silver halide tabular grain emulsion Em-1 was prepared.

| | | | |
|---|---|---|---|
| A2 | Ossein gelatin | 34.03 | g |
| | S-3 (in an aqueous 10% ethanol solution) | 2.25 | ml |
| | Seed emulsion-1 | Equivalent to 1.218 | mols |
| | Water to make | 3150 | ml |
| B2 | Potassium bromide | 1734 | g |
| | Water to make | 3644 | ml |
| C2 | Silver nitrate | 2478 | g |
| | Water to make | 4165 | ml |
| D2 | A fine-grained emulsion* comprising 3 wt % of gelatin and silver iodide grains (having an average grain-size of 0.05 $\mu$) | Equivalent to 0.080 | mol |

*: To 6.64 liters of an aqueous 5.0 wt % gelatin solution containing 0.06 mol of potassium iodide, 2 liters each of an aqueous solution containing 7.06 mol of silver nitrate and an aqueous solution containing 7.06 mol of potassium iodide were added by taking 10 minutes. In the course of forming the fine grains, the pH was controlled to be 2.0 by making use of silver nitrate, and the temperature was controlled to be 40° C. After completing the grain formation, the pH was adjusted to be 6.0 by making use of an aqueous sodium carbonate solution.

In a reaction vessel, Solution A2 was vigorously stirred with keeping the temperature at 60° C. Thereto a part of Solution B2, a part of Solution C2 and the half amount of Solution D2 were each added in a triple-jet process by taking 5 minutes. Thereafter, the half amounts each of the remaining Solutions B2 and C2 were added successively by taking 37 minutes and, finally, the whole remaining amount of Solutions B2 and C2 were each added by taking 33 minutes. In the above-mentioned courses, the pH and pAg thereof were kept at 5.8 and 8.8 for all the while. Wherein, the flowing rates of Solutions B2 and C2 were acceleratedly varied so as to meet the critical growth rate.

Further, the above-mentioned Solution D2 was added in an amount equivalent to 0.15 mol % of the whole silver amount, so that a halogen conversion was performed.

After completing the additions, the resulting emulsion was cooled down to 40° C. and, thereto, 1800 ml of an aqueous solution of 13.8 wt % of gelatin modified with a phenylcarbamoyl group (substitution ratio of 90%), was added as a polymeric flocculent. The resulting emulsion was then stirred for 3 minutes. Thereafter, an aqueous 56 wt % of acetic acid solution was added thereto. The pH of the emulsion was adjusted to be 4.6. The emulsion was stirred for 3 minutes and was then allowed to stand for 20 minutes. The resulting supernatant was removed away by means of a decantation. Then, 9.0 liters of distilled water having a temperature of 40° C. was added. After stirring and then allowing it to stand, the resulting supernatant was removed away and 11.25 liters of distilled water was further added thereto. After stirring and allowing it to stand, the resulting supernatant was removed away. Successively, an aqueous gelatin solution and an aqueous 10 wt % sodium carbonate solution were added and the pH thereof was adjusted to be 5.80. The resulting solution was stirred at 50° C. for 30 minutes and was then redispersed. After completing the redispersion, the pH and pAg thereof were adjusted at 40° C. to be 5.80 and 8.06, respectively.

When observing the resulting silver halide emulsion through an electron microscope, it was proved to be the tabular-shaped silver halide grains having the average grain-size of 1.11 $\mu$, the average thickness of 0.25 $\mu$, the average aspect ratio of about 4.5 and the grain-size distribution of 18.1%. The average distance between the twin planes of the grains was 0.020 $\mu$. In the ratio of the distance between the twin planes to the grain thickness, the grains having not lower than 5 thereof were proved to account for 97% (in numbers) of the total tabular-shaped silver halide grains. Those having not less than 10 were proved to account for 49% of the total grains, and those having not less than 15 accounted for 17% thereof. Further, emulsion Em-2 comprised of tabular grains having an average aspect ratio of 7.0 and silver iodide content of 0.3 mol % and emulsion Em-3 comprised of tabular grains having an average aspect ratio of 2.5 and silver iodide content of 0.3 mol % were prepared in a manner similar to emulsion Em-1, provided that amounts of silver nitrate, potassium bromide and potassium iodide, pH and pAg were varied.

Next, the resulting emulsion (Em-1) was raised to be 60° C. and a given amount of a spectral sensitization dye was added thereto in the form of a solid fine-grain dispersion. After adding it, an aqueous mixed solution of adenine, ammonium thiocyanate, chloroauric acid and sodium thiosulfate and a dispersion of triphenyl phosphine selenide were added and, after 60 minutes, a silver iodide fine-grained emulsion was added. Then, a chemical-ripening treatment was carried out for two hours in total. At the time of completing the ripening treatment, a given amount of 4-hydroxy-6-methyl-1,3,3a,7-tetrazaindene (TAI) was added as a stabilizer.

The above-mentioned additives and the amount of them added (per mol of AgX) are shown below.

| | |
|---|---|
| Sensitizing dye (A), anhydride of sodium 5,5'-dichloro-9-ethyl-3,3'-(3-sulfopropyl)-oxacarbocyanine | 400 mg |
| Sensitizing dye (B), an anhydride of sodium 5,5'-di-(butoxycarbonyl)-1,1'-diethyl-3,3'-di-(4-sulfobutyl)-benzoimidazolocarbo-cyanine | 4.0 mg |
| Adenine | 15 mg |
| Potassium thiocyanate | 95 mg |
| Chloroauric acid | 2.5 mg |
| Sodium thiosulfate | 2.0 mg |

-continued

| | |
|---|---|
| Triphenylphosphine selenide | 0.2 mg |
| Silver iodide fine grains | 280 mg |
| 4-hydroxy-6-methyl-1,3,3a,7-tetrazaindene (TAI) | 500 mg |

The solid, fine-grain, dispersion of the spectral sensitization dyes were each prepared in the process according to the process described in Japanese Patent Application No. 4-99437. To be more concrete, they were prepared in such a manner that a given amount of the spectral sensitization dye was added to water thermally controlled to be 27° C. and it was stirred at 3,500 rpm by making use of a high-speed dissolver for a period within the range of 30 to 120 minutes.

The dispersion of the above-mentioned selenium sensitizer was prepared in the following manner. Thus, 120 g of triphenylphosphine selenide was added to 30 kg of ethyl acetate kept at 50° C. and then so stirred as to be dissolved completely. On the other hand, 3.8 kg of photographic gelatin was dissolved in 38 kg of water and, thereto, an aqueous 25 wt % of sodium dodecylbenzene sulfonate was added. Next, these two solutions were mixed up and the resulting mixture was dispersed at 50° C. for 30 minutes by making use of a high-speed stirring disperser provided with a 10-cm dissolver at a dispersion blade speed of 40 m/sec. Thereafter, the remaining ethyl acetate was removed while a stirring was rapidly carried out under reduced pressure so that the ethyl acetate concentration could be not higher than 0.3 wt %. Then, the resulting dispersion was diluted by making use of pure water so as to make 80 kg. A part of the resulting dispersion was fractionally extracted so as to use for the above-mentioned experiment.

Preparation of emulsion layer coating solution

The following additives were added to each of the emulsions prepared in the above-mentioned manner.

| | |
|---|---|
| Compound (G) | 0.5 mg/m$^2$ |
| 2,6-bis(hydroxyamino)-4-diethylamino-1,3,5-triazine | 5 mg/m$^2$ |
| 1,1-Dimethylol-1-brom-1-nitromethane | 70 mg/m$^2$ |
| t-butyl-catechol | 130 mg/m$^2$ |
| Polyvinyl pyrrolidone (having a molecular weight of 10,000) | 35 mg/m$^2$ |
| A styrene-maleic acid anhydride copolymer | 80 mg/m$^2$ |
| Sodium polystyrene sulfonate | 80 mg/m$^2$ |
| Trimethylol propane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| Colloidal silica (Ludox AM produced by du Pont, av. size: 0.013 $\mu$m) | 0.5 g/m$^2$ |

Gelatin was adjusted to be in an amount of 1.5 g/m$^2$.

Preparation of protective layer:

| | |
|---|---|
| Gelatin | 0.8 g/m$^2$ |
| A matting agent comprising polymethyl methacrylate (having an area average particle-size of 7.0 $\mu$m) | 50 mg/m$^2$ |
| Hardener $(CH_2{=}CHSO_2CH_2)_2O$ | 36 mg/m$^2$ |
| Sodium 2, 4-dichloro-6-hydroxy-1,3,5-triazine | 10 mg/m$^2$ |
| Latex (L) | 0.2 g/m$^2$ |
| Polyacrylamide (having an average molecular weight of 10000) | 0.2 g/m$^2$ |
| Sodium polyacrylate | 30 mg/m$^2$ |

-continued

| | |
|---|---|
| Polysiloxane (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| Compound (F-1) | 3 mg/m$^2$ |
| Compound (F-2) | 2 mg/m$^2$ |
| Compound (F-3) | 1 mg/m$^2$ |

The amounts of the raw materials provided were for one side use, and the amounts of silver provided were each adjusted to be 1.6 g/m$^2$ for one side use.

Preparation of crossover-light shielding layer:

On the both sides of the subbed support, the following crossover-light shielding layer was coated so as to have the following composition.

| | |
|---|---|
| Solid fine-grain dispersion of dye (AH) | 50 mg/m$^2$ |
| Gelatin | 0.2 g/m$^2$ |
| Sodium dodecylbenzene sulfonate | 5 mg/m$^2$ |
| Compound (I) | 5 mg/m$^2$ |
| Sodium 2,4-dichloro-6-hydroxy-1,3,5-triazine | 5 mg/m$^2$ |
| Colloidal silica (having an average particle-size of 0.014 $\mu$m) | 10 mg/m$^2$ |
| Poly(potassium stylenesulfonate) | 50 mg/m$^2$ |

Compound (G)

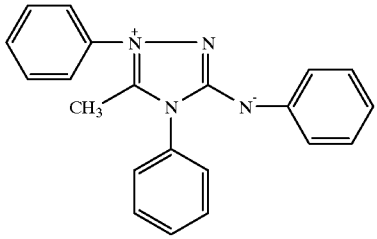

Compound (H)

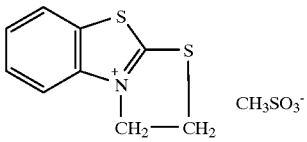

Compound (I)

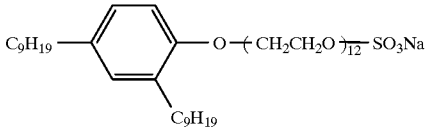

Compound (J)

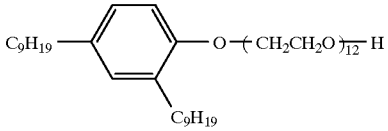

-continued
Compound (K)
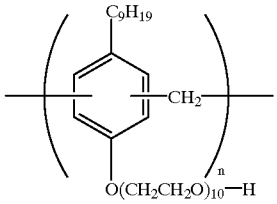
(Mixture, n = 2 - 5)
Compound (S-1)
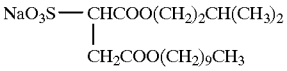
Compound (S-2)
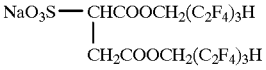
Compound (S-3)
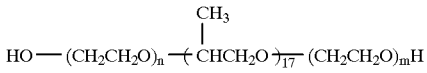
Latex (L)
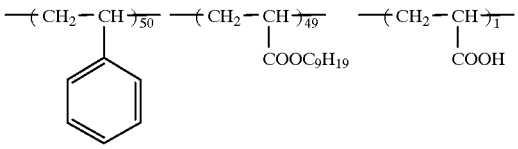
Polysiloxane (SI)
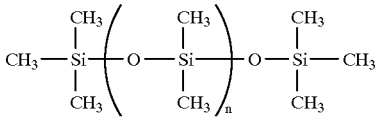
Dye in the form of solid particle dispersion (AH)
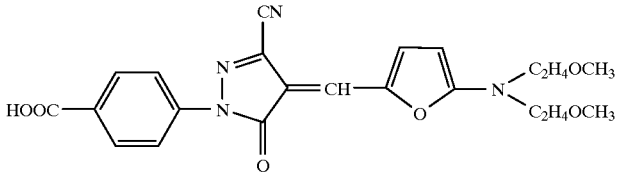
Compound (O)
$C_{11}H_{23}CONH(CH_2CH_2O)_5H$
Compound (F-1)
$C_9H_{19}O—(CH_2CH_2O)_{11}—H$
Compound (F-2)
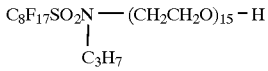

-continued

Compound (F-3)

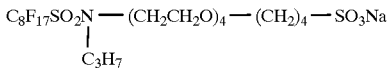

Coating:

These coating solutions were simultaneously coated on both sides of the support in amounts of silver of 1.6 g/m$^2$ and gelatin of 2.5 g/m$^2$, respectively, each per one side of support, using a slide hopper type coating machine at a speed of 120 per min. so as to have the following layer constitution; and dried for 2 min. 20 sec. Thus coated samples were prepared.

| Layer position | Kind of layer | Gelatin amt. of one side (g/m$^2$) |
|---|---|---|
| Upper layer | Protective layer | 0.8 |
| Intermediate layer | Emulsion layer | 1.5 |
| Lower layer | Filter layer | 0.2 |

Preparation of emulsion Em-4

Monodispersed cubic seed grain emulsion *Em-B( was prepared in the following manner.

Solution A

| | |
|---|---|
| Ossein gelatin | 30 g |
| KBr | 1.25 g |
| Nitric acid (0.1N) | 150 ml |
| Distilled water to make | 7700 ml |

Solution B

| | |
|---|---|
| KBr | 6 g |
| KI | 0.16 g |
| Distilled water to make | 740 ml |

Solution C

| | |
|---|---|
| KBr | 680 g |
| KI | 20 g |
| Distilled water to make | 2480 ml |

Solution D

| | |
|---|---|
| Silver nitrate | 8.4 g |
| nitric acid (0.1N) | 32 ml |
| Distilled water to make | 740 ml |

Solution E

| | |
|---|---|
| Silver nitrate | 991.6 g |
| Nitric acid (0.1N) | 80 ml |
| Distilled water to make | 2480 ml |

To solution A with stirring were simultaneously added solutions B and D by the double jet addition for a period of 10 min., and then solutions C and E were further added at a linearly accelerated flow rate (8 times from start to finish) for a period of 140 min., while the pH and pAg were controlled at 2 and 8, respectively. After completing addition, the pH was adjusted to 6 with sodium carbonate, 150 g of KBr was added thereto, and emulsion was washed to remove soluble salts to obtain silver iodobromide cubic seed grain emulsion (Em-B) with an average grain size of 0.3 $\mu$m and a silver iodide content of 2 mol %. According to electron microscopic observation, occurrence of twin crystals was not more than 1% by number.

Using the following five solutions was prepared a regular crystal grain emulsion (Em-4) with a silver iodide content of 2.0 mol %.

Solution A

| | |
|---|---|
| Ossein gelatin | 75.5 g |
| HO—$(CH_2CH_2O)_n$—[$CH(CH_3)CH_2O$]—$(CH_2CH_2O)_m$H (n + m = 5.7) 10% methanol aqueous solution | 15 ml |
| Seed grain emulsion (Em-B) | 0.40 mole equivalent |
| Distilled water to make | 4000 ml |

Solution B

| | |
|---|---|
| Silver nitrate | 46.2 g |

Ammonia in an equimolar amount to silver nitrate and distilled water were added to make 259 ml.

Solution C

| | |
|---|---|
| Silver nitrate | 647.6 g |

Ammonia in an equimolar amount to silver nitrate and distilled water were added to make 1088 ml.

Solution D

| | |
|---|---|
| KBr | 22.6 g |
| KI | 13.5 g |
| Distilled water to make | 259 ml |

Solution E

| | |
|---|---|
| KBr | 453.3 g |
| Distilled water to make | 1088 ml |

Solution A was kept at 40° C. and the pH was adjusted to 9.5 by adding ammonia and acetic acid. After adjusting the pAg to a value 7.3 using ammoniacal silver ion solution, solutions B and D were added by double jet addition with pH and pAg controlled at constant values to form a silver iodobromide core containing 30 mol % silver iodide. After adjusting the pH and pAg to 9.0 and 9.0, respectively using acetic acid and KBr, solutions C and E were simultaneously added to grow grains until reached 90% of the final grain diameter, while the pH was gradually varied from 9.0 to 8.2. After adjusting the pAg to 11 by adding KBr, solutions C and E were further added to grow the grains with gradually lowering the pH to 8. The resulting emulsion was subjected to coagulation washing to remove soluble salts and a silver iodobromide emulsion with a silver iodide content of 2 mol % (Em-4) was obtained. As a result of microscopic observation of about 1,000 grains of Em-4, the emulsion was comprised of monodispersed spherical grains with an average diameter of 0.51 $\mu$m and width of distribution of 12%.

Emulsion Em-4 was subjected to spectral sensitization and chemical sensitization according to the following procedure.

To the emulsion kept at 50° C. was added a solid fine particle dispersion of afore-mentioned sensitizing dye (A) in an amount of 400 mg per mol of silver halide and further thereto were added $7.0\times10^{-6}$ mol of a selenium sensitizer, $4.0\times10^{-4}$ mol of ammonium thiocyanate, $3.2\times10^{-6}$ mol of chloroauric acid and $3.4\times10^{-5}$ mol of sodium thiosulfate. After ripening for 40 min., a silver iodobromide fine grain emulsion was added in an amount of $1.7\times10^{-3}$ mol/Ag mol, and further thereto was added 4-hydroxy-6-methyl-1,3,3a, 7-tetrazaindene (TAI) in an amount of $1.2\times10^{-2}$ mole.

Selenium sensitizer

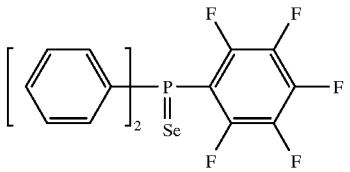

Preparation photographic material

To the emulsion were the following additives to prepare a coating solution of an emulsion layer. The addition amount is expressed in per mol of silver halide.

| | | |
|---|---|---|
| t-Butylcatechol | 400 | mg |
| polyvinyl pyrrolidone (M.W. 10,000) | 1.0 | g |
| Copolymer of styrene and anhydrous maleic acid | 2.5 | g |
| Trimethylol propane | 10 | g |
| Diethylene glycol | 5 | g |
| Nitrophenyl-triphenylphosphonium chloride | 50 | mg |
| Ammonium 1,3-dihydroxybenzene-4-sulfonate | 4 | g |
| Sodium 2-mercaptobenzimidazole-5-sulfonate | 1.5 | mg |
| n-$C_4H_9OCH_2CH(OH)CH_2N(CH_2COOH)_2$ | 1 | g |
| Compound (G) | 150 | mg |
| Compound (H) | 70 | mg |

In a protective layer were employed the following additives, wherein the addition amount was expressed in per g of gelatin.

| | |
|---|---|
| Matting agent (polymethyl metacrylate with an average particle size of 7 $\mu$m) | 7 mg |
| Colloidal silica (av. particle size 0.013 $\mu$m) | 70 mg |
| 2,4-Dichloro-6-hydroxy-1,3,5-triazine sodium salt | 30 mg |
| Compound (I) | 12 mg |
| Compound (J) | 2 mg |
| Compound (S-1) | 7 mg |
| Compound (K) | 15 mg |
| Compound (F-1) | 3 mg |
| Compound (S-2) | 5 mg |
| $(CH_2{=}CHSO_2CH_2)_2O$ | 36 mg |

On both sides of the afore-mentioned subbed support were coated an emulsion layer and a protective layer and dried to prepare a photographic material sample. The silver coating amount of the emulsion layer per one side was 2.20 g/m$^2$.

A developer in solid form relating to the invention and a developer in liquid form were prepared in the following manner.

Preparation of solid developer composition ($\alpha$) containing hydroquinone as a developing agent A solid developer composition, which was employed as 100 liters of a developing solution, was prepared in the following manner.

Preparation of granules (A):

Hydroquinone of 3,000 g, 1-phenyl-3-pyrazolidone of 400 g, N-actyl-D,L-penicillamine of 10 g and sodium glutaraldehyde bissulfite of 500 g each were pulverized up in a commercially available mill so as to have an average particle size of 10 $\mu$m. To the resulting fine particles, were added a reductone as shown in Table 1, sodium sulfite of 700 g and D-sorbit of 200 g. In stirring granulator commercially available, the resulting mixture was granulated for 5 min. at room temperature by adding 30 ml of water. The resulting granules were dried up at 40° C. for 2 hr. in a fluidized bed drier so that the moisture content of the granules was almost completely removed off.

Preparation solid developing composition A:

Thus prepared granules (A) was mixed with sodium 1-octanesulfonate of 100 g for 10 min. by making use of a mixer in a room controlled to be not higher than 25° C. and 40% RH. The resulting mixture was compression-tableted so as to have a filling amount of 10 g per tablet, by making use of a tableting machine that was modified model of Tough Press Collect 1527HU manufactured by Kikusui Mfg. Works, Inc. Thereby, hydroquinone type developing composition tablets with 30 mm in diameter were prepared.

Granules (B):

Potassium carbonate of 10,000 g, sodium bicarbonate of 1,000 g and KBr of 200 g each were pulverized up in a commercially available mill so as to have an average particle size of 10 $\mu$m. To the resulting fine particles, were added LiOH $H_2O$ of 200 g DTPA·5Na of 250 g, 1-phenyl-5-mercaptotetrazole of 5.0 g, sodium sulfite of 4,000 g and D-mannit of 1,000 g. In stirring granulator commercially available, the resulting mixture was granulated for 5 min. at room temperature by adding 30 ml of water. The resulting granules were dried up at 40° C. for 2 hr. in a fluidized bed drier so that the moisture content of the granules was almost completely removed off to obtain granules (B).

Preparation solid developing composition B:

Thus prepared granules (b) was mixed with sodium 1-octanesulfonate of 200 g for 10 min. by making use of a mixer in a room controlled to be not higher than 25° C. and 40% RH. The resulting mixture was compression-tableted so as to have a filling amount of 10 g per tablet, by making use of a tableting machine that was modified model of Tough Press Collect 1527HU manufactured by Kikusui Mfg. Works, Inc. Thereby, alkaline developing composition tablets with 30 mm in diameter were prepared.

Preparation of solid developer composition ($\beta$) containing a reductone as a developing agent Preparation of granules (A):

1-Phenyl-3-pyrazolidone of 300 g, N-actyl-D,L-penicillamine of 10 g and sodium glutaraldehyde bissulfite of 500 g each were pulverized up in a commercially available mill so as to have an average particle size of 10 $\mu$m. To the resulting fine particles, were added sodium metabisulfite of 1,500 g, a reductone as shown in Table 1 and D-sorbit of 600 g. In stirring granulator commercially available, the resulting mixture was granulated for 5 min. at room temperature by adding 30 ml of water. The resulting granules were dried up at 40° C. for 2 hr. in a fluidized bed drier so that the moisture content of the granules was almost completely removed off.

Preparation solid developing composition A:

Thus prepared granules (A) was mixed with sodium 1-octanesulfonate of 80 g for 10 min. by making use of a mixer in a room controlled to be not higher than 25° C. and 40% RH. The resulting mixture was compression-tableted so as to have a filling amount of 10 g per tablet, by making use of a tableting machine that was modified model of Tough Press Collect 1527HU manufactured by Kikusui Mfg. Works, Inc. Thereby, developing composition tablets containing a reductone developing agent were prepared.

Granules (B):

Potassium carbonate of 9,000 g and sodium bicarbonate of 100 g each were pulverized up in a commercially available mill so as to have an average particle size of 10 μm. To the resulting fine particles, were added DTPA·5Na of 250 g, Z-1 of 40 g, Z-2 of 10 g, KI 0f 7 g, methyl-β-cyclodextrin of 200 g, binder mannitol of 2,000 g and D-sorbit of 700 g. In stirring granulator commercially available, the resulting mixture was granulated for 5 min. at room temperature by adding 30 ml of water. The resulting granules were dried up at 40° C. for 2 hr. in a fluidized bed drier so that the moisture content of the granules was almost completely removed off to obtain granules (B).

Z-1

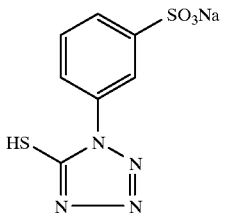

Z-2

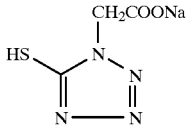

Preparation solid developing composition B:

Thus prepared granules (B) was mixed with sodium 1-octanesulfonate of 150 g for 10 min. by making use of a mixer in a room controlled to be not higher than 25° C. and 40% RH. The resulting mixture was compression-tableted so as to have a filling amount of 10 g per tablet, in a manner similar to the above by making use of a tableting machine. Thereby, alkaline developing composition tablets with 30 mm in diameter were prepared.

The above-described developing compositions in the form of a tablet A and B were packaged into a pillow bag containing aluminum for moisture-proof, in an amount of 4.0 liters of the developing solution.

A solid fixing composition, which was employed as 100 liters of a fixing solution, was prepared in the following manner.

Granules (C):

Ammonium thiosulfate/sodium thiosulfate (90/10 by weight) of 15,000 g was pulverized up in a commercially available mill so as to have an average particle size of 10 μm. To the resulting fine powder, were added sodium sulfite of 500 g, $Na_2S_2O_5$ of 750 g and binder Pineflow of 1,300 g and the mixture was mixed in the mill for 3 min. In stirring granulator commercially available, the resulting mixture was granulated by adding 50 ml of water. The resulting granules were dried up at 40° C. in a fluidized bed drier so that the moisture content of the granules was almost completely removed off.

Granules (D):

Boric acid of 400 g, aluminum sulfate octahydrate of 1,200 g, cinnamic acid of 1200 g and tartaric acid of 300 g were pulverized up in a commercially available mill so as to have an average particle size of 10 μm. To the resulting fine particles was added D-mannit of 250 g, D-sorbit of 120 g and PEG #4000 of 160 g and the resulting mixture was granulated by adding 30 ml of water. The resulting granules were dried up at 40° C. in a fluidized bed drier so that the moisture content of the granules was almost completely removed off.

To the thus prepared granules (C) were added β-alanine of 3000 g, sodium acetate of 4330 g and sodium 1-octanesulfonate in an amount so as to be 1.5% of the total weight, to granule (D) were added sodium metabisulfite of 750 g and sodium 1-octanesulfonate in an amount so as to be 1.0% of the total weight, and each mixed for 10 min. by making use of a mixer in a room controlled to be not higher than 25° C. and 40% RH. Each of the mixture was compression-tableted so as to have a filling amount of 10.2 g per tablet (C) and 11.2 g per tablet (D), by making use of a tableting machine that was modified model of Tough Press Collect 1527HU manufactured by Kikusui Mfg. Works, Inc. Thus prepared fixing compositions C and D in the form of a tablet were each packaged into a pillow bag containing aluminum for moisture-proof, in an amount for 4 liters of the fixing solution.

There was employed an automatic processor, modified SRX-201 (produced by Konica Corp.). Processing was conducted at a developing temperature of 35° C. and at a fixing temperature of 35° C. for a overall processing time (Dry to Dry) of 40 sec.

A starting developer solution in a developing tank was prepared so as to dissolve packaged tablets of developing composition-tablet in 4 liters of water using a modified chemical mixer. In this case, the tablets were completely dissolved and no precipitate was observed. Thus prepared developing solution of 7.8 1 was introduced into the processor, modified SRX-201 and a starter having the composition as below was added thereto in amount of 35 ml/l to prepare a starting developing solution. A fixing solution for use in the processor was prepared so as to dissolve packaged fixing composition-tablets in 4 liters of water using the chemical mixer. In the thus prepared fixing solution, the tablets were completely dissolved and no precipitate was observed. The fixing solution of 5.6 liters was introduced into a processor SRX-201 as a starting fixer solution.

| Starter | | |
|---|---|---|
| KBr | 5.5 | g |
| $HO(CH_2)_2S(CH_2)_2S(CH_2)_2OH$ | 0.05 | g |
| N-acetyl-D,L-penicilamine | 0.10 | g |
| Sodium metabisulfite for pH-adjustment | | |
| Water to make | 35 | ml |

In SRX-201, an inlets of a modified chemical mixer for supplying each of the developing and fixing solid compositions was provided and a built-in chemical mixer was modified for dissolving the solid processing composition.

An opened package of solid developing or fixing composition tablets was set at the inlet of modified chemical mixer and at the same time when the tablets was supplied into the tank, warm water (25 to 30° C.) was also introduced to prepare the processing solution of 4.0 liter, with stirring and dissolving for 25 min. The resulting solution was used as a replenishing solution for developing or fixing solution. The pH of the developing solution and fixing solution was respectively adjusted to 10.15 and 4.80 with acetic acid or potassium hydroxide. The built-in chemical mixer was comprised of a supplying tank and an auxiliary tank, each having a volume of 4 liters. The auxiliary tank was provided so as to supply a replenishing solution, without no supply of the replenishing solution, during the time a replenishing solution prepared in the supplying tank was exhausted during the running process and the solid processing compositions were being dissolved for a period of 25 min. The starter was added and the pH of the developer stating solution was adjusted to 10.45 (α) and 9.90 (β).

A developing solution (γ) was also prepared using the following concentrated liquid developing chemicals A,B and C, in place of the above-described solid developing composition. The starter above-described was also added thereto to prepare a developer starting solution, and processing was conducted in a manner similar to the above. A fixing solution was the same as above.

| Reductone as shown in Table 1 | | |
|---|---|---|
| A-part | | |
| 4-Hydroxymethyl-4-methyl-1-phenyl-3 - pyrazolidone | 4 | g |
| Potassium sulfite (50% solution) | 70 | g |
| Potassium bicarbonate | 3 | g |
| Potassium carbonate | 100 | g |
| 1-Phenyl-5-mercaptotetrazole | 0.07 | g |
| Diethylene glycol | 70 | g |
| Potassium hydroxide (50% solution) for pH adjustment | | |
| Water to make | 550 | ml |
| The pH was adjusted to 10.80. | | |
| B-part | | |
| Acetic acid (90%) | 22 | g |
| Triethylene glycol | 10 | g |
| N-Acetyl-D,L-penicilamine | 0.2 | g |
| 1-Phenyl-3-pyrazolidone | 2.0 | g |
| 4-Hydroxymethyl-4-methyl-1-phenyl-3-pyrazolidone | 4 | g |
| 5-Nitroindazole | 0.02 | g |
| C-part | | |
| Glutar aldehyde (50% solution) | 5.0 | g |

The above A, B and C parts were dissolved in water to make 1 liter of developing solution (γ). The pH was 10.10.

Photographic materials were processed and evaluated in the following manner. Thus, photographic films at a size of 10×12 inches, which were previously exposed so as to give a density of 1.0, were subjected to running process over a period of 3 months, provided that 60 sheets were processed over 8 hrs. per day at replenishing rates as shown in Table 1.

Evaluation of slippage

A film sheet at a cabinet size was processed by the processor so that the short edge of the film was directed to be.perpendicular to the transporting direction, and the total processing time (dry to dry) was measured. The difference between the apparent passing length calculated from the real transport time and transport speed, and the theoretical passing length within the processor was defined as the slippage. The less the slippage, the better.

Evaluation of unevenness of development density

A film sheet with a size of 14×14 inches was overall exposed so as to give a density of 1.0 and processed in a running process. The processed film was evaluated with respect to unevenness of the density, based on the following criteria:

4: No unevenness is observed.

3: Random streaked unevenness with slight density differences is observed.

2: Distinct density difference and overall unevenness are observed, making the film unacceptable for practical use.

1: Wide streaks of marked density difference are observed and with overall unevenness.

Evaluation of uneven drying

After 100 sheets of film were continuously processed so that the carried-in water content of the film squeezed in the processor SRX-201 reached equilibrium, a single sheet film that was exposed so as to give a density of 1.0 was processed. Unevenness observed by reflection of the processed film was evaluated, based on the following criteria:

4: No unevenness is observed by reflection,

3: Random streaked unevenness was observed by reflection but at acceptable levels for practical use.

2: Slight overall unevenness is observed by reflection.

1: Overall or widely streaked unevenness is observed by reflection.

Results thereof are shown in Table 2.

TABLE 1

| Sample No. | Support | (thickness, μm) | Emulsion | Developer Kind | Developer Form | Developer Reductone (mol/l) | Replenishing rate (ml/time) Developer | Replenishing rate (ml/time) Fixer |
|---|---|---|---|---|---|---|---|---|
| 1 | PEN | 60 | Em-1 | β Tablet | A-1 | (0.20) | 14 | 14 |
| 2 | PEN | 100 | Em-1 | β Tablet | A-1 | (0.20) | 14 | 14 |
| 3 | PEN | 180 | Em-1 | β Tablet | A-1 | (0.20) | 14 | 14 |
| 4 | PEN | 180 | Em-1 | β Tablet | A-1 | (0.20) | 14 | 14 |
| 5 | PEN | 180 | Em-2 | β Tablet | A-1 | (0.20) | 14 | 14 |
| 6 | PEN | 180 | Em-3 | β Tablet | A-1 | (0.20) | 14 | 14 |
| 7 | PEN | 180 | Em-4 | β Tablet | A-1 | (0.20) | 14 | 14 |
| 8 | PEN | 180 | Em-1 | β Granule | A-1 | (0.20) | 14 | 14 |
| 9 | PEN | 180 | Em-1 | α Tablet | A-1 | (0.02) | 14 | 14 |
| 10 | PEN | 180 | Em-1 | α Tablet | — | — | 14 | 14 |
| 11 | PEN | 180 | Em-1 | γ Liquid | A-1 | (0.20) | 14 | 14 |
| 12 | PEN | 180 | Em-1 | β Tablet | A-1 | (0.20) | 7 | 7 |
| 13 | PET | 100 | Em-1 | β Tablet | A-1 | (0.20) | 14 | 14 |
| 14 | PET | 180 | Em-1 | β Tablet | A-1 | (0.20) | 14 | 14 |
| 15 | PET | 180 | Em-1 | β Tablet | A-1 | (0.20) | 14 | 14 |
| 16 | PET | 180 | Em-1 | β Granule | A-1 | (0.20) | 14 | 14 |
| 17 | PEN | 100 | Em-2 | β Tablet | A-1 | (0.20) | 14 | 14 |
| 18 | PET | 100 | Em-1 | β Granule | A-1 | (0.20) | 7 | 7 |
| 19 | PET | 100 | Em-1 | γ Liquid | A-1 | (0.20) | 14 | 14 |

TABLE 2

| Sample No. | Running process: Start Slipage | Start Uneven developing | Start Uneven drying | After 3 months Slipage | After 3 months Uneven developing | After 3 months Uneven drying | Remark |
|---|---|---|---|---|---|---|---|
| 1 | 4 | 4 | 4 | 5 | 4 | 4 | Inv. |
| 2 | 7 | 4 | 4 | 8 | 4 | 4 | Inv. |
| 3 | 10 | 3.5 | 3.5 | 11 | 3.5 | 3.5 | Inv. |
| 4 | 12 | 3.5 | 3.5 | 13 | 3.5 | 3.5 | Inv. |
| 5 | 10 | 3.5 | 3.5 | 11 | 3.5 | 3.5 | Inv. |
| 6 | 10 | 3.5 | 3.5 | 11 | 3.5 | 3.5 | Inv. |
| 7 | 10 | 3.5 | 3.5 | 11 | 3.5 | 3.5 | Inv. |
| 8 | 10 | 3.0 | 3.5 | 11 | 3.0 | 3.0 | Inv. |
| 9 | 10 | 3.5 | 3.5 | 11 | 3.5 | 3.5 | Inv. |
| 10 | 10 | 3.0 | 3.0 | 11 | 3.0 | 3.0 | Inv. |

TABLE 2-continued

| | Running process | | | | | | |
|---|---|---|---|---|---|---|---|
| | Start | | | After 3 months | | | |
| Sample No. | Slipage | Uneven developing | Uneven drying | Slipage | Uneven developing | Uneven drying | Remark |
| 11 | 16 | 3.0 | 3.0 | 19 | 2.0 | 2.0 | Comp. |
| 12 | 10 | 3.5 | 3.5 | 11 | 3.5 | 3.5 | Inv. |
| 13 | 22 | 2.0 | 2.0 | 28 | 1.5 | 1.5 | Comp. |
| 14 | 30 | 1.5 | 1.5 | 37 | 1.0 | 1.0 | Comp. |
| 15 | 30 | 1.5 | 1.5 | 37 | 1.0 | 1.0 | Comp. |
| 16 | 30 | 1.5 | 1.5 | 37 | 1.0 | 1.0 | Comp. |
| 17 | 7 | 4.0 | 4.0 | 8 | 4.0 | 4.0 | Inv. |
| 18 | 23 | 1.5 | 1.5 | 29 | 1.Q | 1.0 | Comp. |
| 19 | 17 | 2.5 | 2.5 | 19 | 2.0 | 2.0 | Comp. |

As can be seen from Tables 1 and 2, inventive samples led to reduced slipping and improvements in uneven developing and even drying. Specifically in the running equilibrium in which accumulation of chemicals increased as a result of running process and concentration of processing solutions due to vaporization , improvements were markedly displayed. It is further noted that the use of reductones as a developing agent led to improvements in uneven developing and the use of a support with a thickness of 50 to 130 $\mu$m also resulted in improvements in uneven developing and drying.

What is claimed is:

1. A method for processing a silver halide black-and-white photographic light sensitive material comprising a transparent polyester support having thereon hydrophilic colloid layers including a silver halide emulsion layer, by the use of an automatic processor, the method comprising the steps of developing with a developing solution, fixing with a fixing solution, washing and drying, wherein the polyester support is a biaxially stretched polyester film obtained from a naphthalenedicarboxylic acid and a diol; the developing solution and the fixing solution being prepared by dissolving, in water, a solid developing composition and a solid fixing composition, respectively.

2. The processing method of claim 1, wherein said polyester film is obtained from 2,6-naphthalenedicarboxylic acid and ethylene glycol.

3. The processing method of claim 1, wherein said polyester support has a thickness of 50 to 130 $\mu$m.

4. The processing method of claim 1, wherein said solid developing composition and solid fixing composition each are in the form of granules or a tablet.

5. The processing method of claim 1, wherein said solid developing composition and solid fixing composition each are in the form of a tablet.

6. The processing method of claim 1, wherein said solid developing composition and solid fixing composition each contains a saccharide or a compound represented by formula (B), and a compound represented by formula (C):

$$HO—(A_1—O)_{l1}-(A_2—O)_{l2}-(A_3—O)_{l3}—H \qquad \text{formula (B)}$$

wherein $A_1$, $A_2$ and $A_3$ each represent an alkylene group; $l_1$, $l_2$ and $l_3$ each represent 0 or an integer of 1 to 500, provided that the sum of $l_1$, $l_2$ and $l_3$ is not less than 5, $$R—SxOyM \qquad \text{formula (C)}$$

wherein R represents an aliphatic group, an aromatic group or a heterocyclic group, x is 1 or 2, y is an integer of 2 to 8, and M represents a cation.

7. The processing method of claim 1, wherein said solid developing composition contains a reductone as a developing agent.

8. The processing method of claim 2, wherein said polyester support has a thickness of 50 to 130 $\mu$m.

9. The processing method of claim 6, wherein said polyester film is obtained from 2,6-naphthalenedicarboxylic acid and ethylene glycol, and said polyester support has a thickness of 50 to 130 $\mu$m.

* * * * *